United States Patent [19]

Capdeboscq et al.

[11] Patent Number: 4,613,268

[45] Date of Patent: Sep. 23, 1986

[54] PROCESS AND APPARATUS FOR THE AUTOMATIC SUPPLY OF A MACHINE FOR PROCESSING PRODUCTS IN THE FORM OF SHEETS

[75] Inventors: Bernard Capdeboscq, Chaleyssin; Marc Cuzin, Craponne, both of France

[73] Assignee: S.A. Martin, Villeurbanne, France

[21] Appl. No.: 589,822

[22] Filed: Mar. 15, 1984

[30] Foreign Application Priority Data

Apr. 8, 1983 [FR] France ..... 83 05985
Feb. 3, 1984 [EP] European Pat. Off. ..... 84400238.6

[51] Int. Cl.[4] ..... B65G 59/02; B65G 59/08

[52] U.S. Cl. ..... 414/114; 198/407; 414/117; 414/330; 414/786

[58] Field of Search ..... 198/406, 407, 409; 414/33, 36, 114, 112, 117, 778, 786, 330, 32

[56] References Cited

U.S. PATENT DOCUMENTS 1,889,846 12/1932 Wright ..... 198/409 X
3,519,144 7/1970 Calistrat ..... 414/36
3,908,836 9/1975 Ikeda ..... 414/114 X
4,119,221 10/1978 Hazard ..... 414/114
4,249,847 2/1981 Tokuno ..... 198/407 X
4,412,769 11/1983 Kollmann ..... 414/36

FOREIGN PATENT DOCUMENTS 2504306 8/1976 Fed. Rep. of Germany ..... 198/407
2313294 12/1976 France .

*Primary Examiner*—Robert J. Spar
*Assistant Examiner*—Janice Krizek

[57] ABSTRACT

An apparatus for the automatic supply of the magazine of the feeder on a slotter/printer with a high production rate for making cases consisting of corrugated cardboard, comprising a device (3, 10, 4) intended for separating a bundle from the top of a stack of blanks (14) by placing this bundle upright on its edge, a retractable device (4) intended for causing the virtually vertical drop of this bundle, and a guide and receiving device (5, 7) making it possible to stop the bundle, still standing on its edge, a device (6) for squaring the bundle laterally after its drop, a device (27, 7, 8) for raising the bundle to a horizontal position, and a device (9) for receiving and discharging this bundle.

19 Claims, 39 Drawing Figures

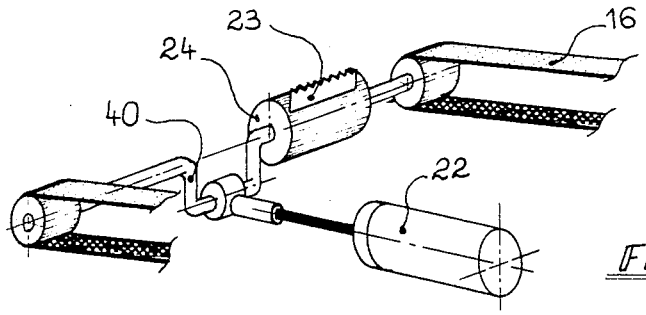
FIG: 4
FIG: 7
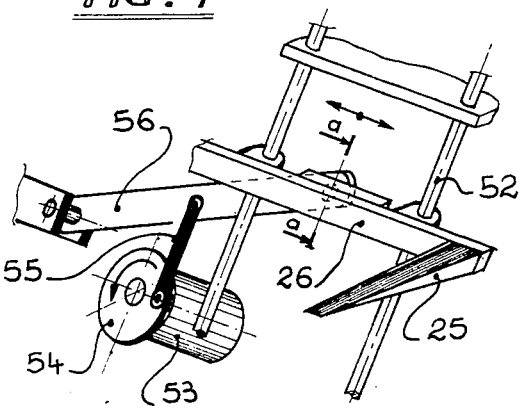
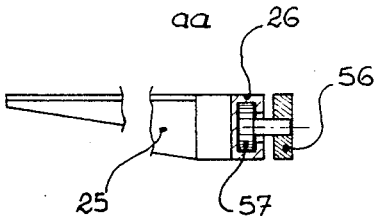
FIG: 7a
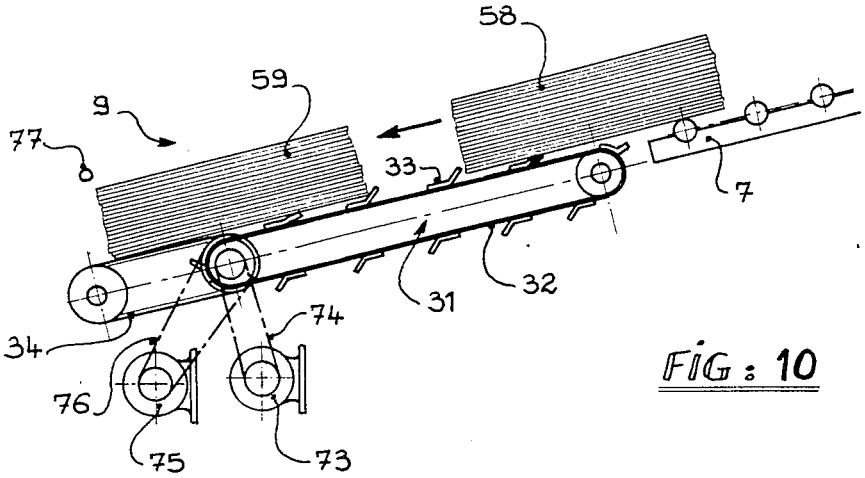
FIG: 10

PROCESS AND APPARATUS FOR THE AUTOMATIC SUPPLY OF A MACHINE FOR PROCESSING PRODUCTS IN THE FORM OF SHEETS

FIELD OF THE INVENTION

The present invention relates to a process and an apparatus for the automatic supply of a machine for processing products in the form of sheets, more particularly for filling the supply magazine of a processing machine automatically with blanks in the form of sheets. Thus, it applies in a particularly effective way, by way of example, to the automatic supply of the magazine of the feeder on a slotter/printer with a high production rate for making cases made of corrugated cardboard.

The manufacture of corrugated-cardboard packing cases involves a first phase in which the corrugated cardboard is prepared in a continuous strip in a corrugating machine, and then cut into rectangular blanks, the dimensions of which correspond to the layout of the case to be produced. In a second stage, the blanks are usually received one by one in a machine called a "slotter/printer" in which they undergo various cutting operations to form, for example, the flaps of the case. Such a machine incorporates an input element called a "feeder", with a supply magazine in which the blanks are stacked so as to be extracted one by one from the bottom of the stack at a rate synchronous with the rotary cutting or printing elements. Between the corrugating machine and the slotter, the cardboard blank sheets are stacked waiting to pass onto the case-making machines, a slotter or flat-cutting machine.

At present, the supply magazine of the slotter is generally filled manually by taking bundles of sheets in succession from a waiting stack. The reserve formed in the magazine of the slotter usually provides sufficient stock, at the end of each stack of blanks, to have enough time to bring another stack up to the slotter and prevent the machine from stopping.

However, it has been noted that the production of modern slotters capable of very high mechanical rates is, in fact, limited by the manual-supply capability. Even when the entire capacity of the slotter is not utilized, the manual loading of the sheets into the magazine is an extremely laborious job. Attempts have therefore been made to automate and above all mechanise the operation of filling the magazine with blanks in such high-speed case-making machines. The solutions proposed hitherto for solving this problem have generally resulted in apparatuses in which the sheets are taken one by one from the top of the waiting stack; these sheets are then transported to the magazine of the feeder by means of conveyor belts, on which they are usually arranged so as to overlap one another.

The disadvantage of all these various apparatuses is that they do not provide any buffer reserves between the main stack and the small pile which forms in the feeder magazine. As a result of this, when a stack is emptied completely into the feeder, the small reserve of the latter is used up in less time than is needed to bring another stack into place and readjust the apparatus to begin the transfer of new sheets. There is, therefore, a break in the supply to the slotter and a loss of production.

Moreover, during their transport between the corrugating machine and the case-making machines, the sheets are never stacked strictly vertically. Consequently, although the upper part of the stack has been centered correctly to ensure that the sheets arrive perfectly along the axis of the slotter, it is often noted that when the lower part of the stack is reached the centering is no longer correct and the sheets again penetrate into the feeder magazine with difficulty.

PRIOR ART

To mitigate these disadvantages, the Applicant has already proposed in his French Pat. No. 2,313,294 a process for the automatic filling of the supply magazine of a machine for processing blanks in the form of sheets, the said magazine serving to compose a stack of sheets forming a small reserve for supplying the machine, with the sheets being taken one by one from the lower part of the reserve to be introduced into the machine and with the reserve being replenished by providing new sheets in its upper part, these new sheets being taken from a waiting stack. This process involved the following operations:

bringing a waiting stack to a sheet-taking station where it remains in a vertical position, and progressively raising this stack after each sheet-taking operation, separating the stack into bundles, first offsetting each time the upper part of the stack by pushing it horizontally to the rear, with the lower part being retained, then slightly lifting the offset rear edge of the bundle formed in this way and pressing on the upper part of the remaining stack to keep it in place, displacing the upper bundle formed in this way horizontally forwards towards a station for delivering the sheets one by one towards the magazine of the machine by taking them from the bottom, the lower part of the stack remaining maintained in place, each transfer of a bundle towards the delivery station taking place only at the end of the delivery of the preceding bundle, this transfer in turn giving rise to a new cycle involving raising the waiting stack and separating a new bundle in its upper part.

This type of process has not proved satisfactory when put into practise, since this requires a complicated mechanism, which is therefore expensive in terms of production and maintenance, and long and difficult adjustment. Moreover, it was necessary to make disproportionately long changes in settings when there was a change in the size of the cardboard sheets. Furthermore, because of the weight of the bundles formed, it was not possible to subject them to lateral squaring without the risk of damaging the sheets, above all when sheets of medium or below-average quality were being used.

In addition, this type of process only makes it possible to obtain a single bundle at any one time, and with high production rates this may provide an insufficient reserve when a stack is changed.

Finally, the way in which this type of process is carried out does not make it possible to turn over the bundle easily before it is delivered sheet by sheet from the bottom. Now, there are certain types of printers, called "high flexographic printers", the use of which requires the blanks to be turned over beforehand.

SUMMARY OF THE INVENTION

The invention relates to a process and an apparatus for the automatic supply, that is to say without the direct manual involvement of an operator, of a machine for processing products in the form of sheets, which do not have this type of disadvantage. The process of the invention involves the following automatic operations:

bringing a waiting stack into the upright position, inclining this stack until it rests on its side, separating a bundle of blanks from the top of the stack the said bundle remaining standing on its edge, dropping this bundle down until it stops, still standing on its edge, squaring this bundle laterally, raising the bundle in a movement bringing it approximately into a horizontal position, discharging this bundle.

BRIEF DESCRIPTION OF THE DRAWINGS

The invention will be understood better by means of the following description of some non-limiting exemplary embodiments, with reference to the attached drawings in which:

FIG. 4 is a diagrammatic perspective view of the bundle-separating device equipping the machine according to FIGS. 1 to 3, FIG. 7 is a diagrammatic perspective view of the device accompanying the bundle drop, equipping the machine of the invention, and FIG. *7a* is a detailed section of this in the direction aa.

FIG. 10 is a diagrammatic longitudinal section through the bundle-receiving device equipping the machine of the invention.

DETAILED DESCRIPTION

Figure 1:
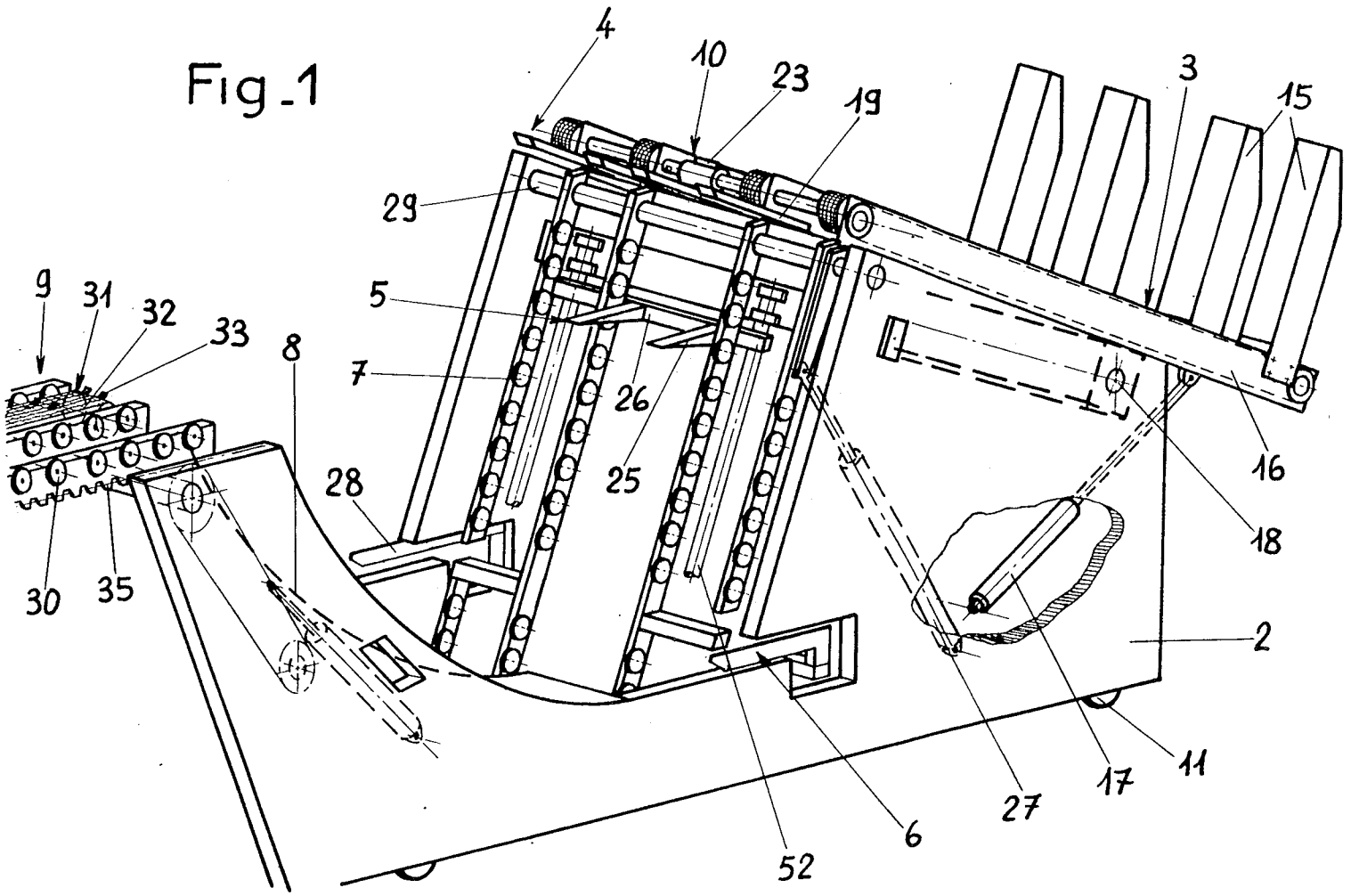
FIG. 1 is a perspective view of the automatic supply machine enabling the invention to be put into practise.
Figure 2:
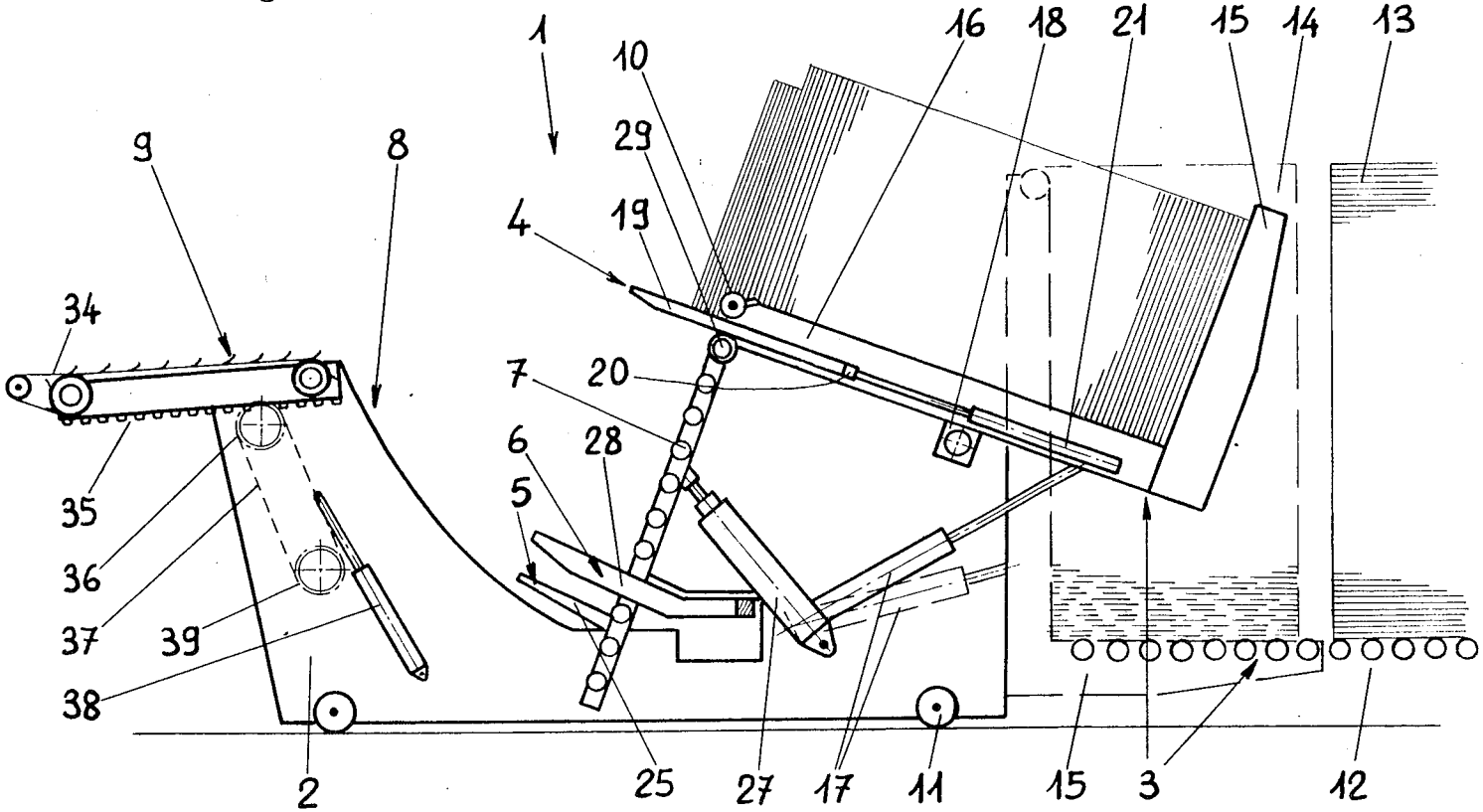
FIG. 2 is a side view of the automatic supply machine of the invention.
Figure 3:
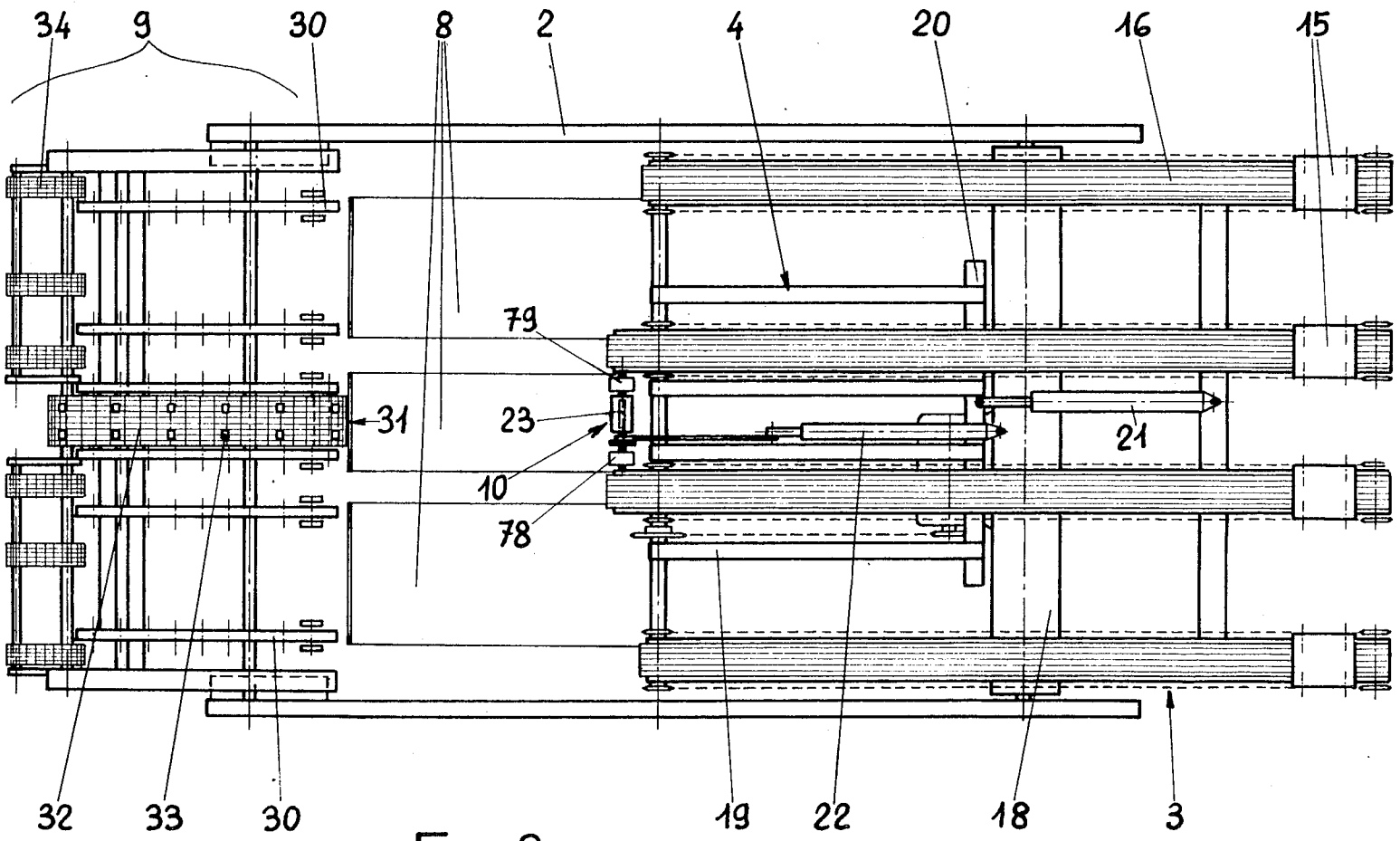
FIG. 3 is a plan view of the machine of the invention.

Referring to the assembly as a whole shown in FIGS. 1 to 3, the machine for the automatic supply of bundles, according to the invention, is a compact machine movable on wheels 11 and comprising essentially:

A supporting frame 2, a tilting lifter plate 3 of a type widely known in the art and described, for example, in French Pat. No. 2,273,656, a device 4, 10 intended for separating bundles from the top of the stack, a device 5 intended for accompanying the vertical drop of the bundles, a device 6 for squaring the bundles laterally after their vertical drop, a device 7, 8 for raising the bundles to a horizontal position, a longitudinally displaceable device 9 for receiving and discharging the bundles.

The machine 1 is normally positioned adjacent to a conveyor 12 for delivering waiting stacks 13, 14. These are, for example, stacks of cardboard sheets leaving a corrugating machine, the said sheets being intended to be introduced one by one, by means of the apparatus of the invention, into a machine for making and printing cases made of corrugated cardboard.

The tilting lifter plate 3 is provided with forks 15 displaceable along a conveyor structure 16 perpendicular to them. In its "upright" position shown by broken lines in FIG. 2, it receives one of the waiting stacks, such as the stack 14, the forks 15 being in their lowest position so as to be inserted into the delivery conveyor 12, the latter consequently being provided with longitudinal spaces.

The plate 3 is tilted, in a highly conventional way for this type of tilting plate, as a result of the extension of the rod of a jack 17, the base of which is articulated on the frame 2 of the machine. The plate 3 then tilts about the shaft 18 into the virtually horizontal position shown in the drawings.

The conveyor structure 16 is extended, with a downward offset, as can be seen in the drawings, in a retractable support 4 consisting of forks 19 assembled on a crosspiece 20 retractable by means of a jack 21. This support 4 makes it possible to provide a step intended to separate a bundle from the top of the stack as a result of gravity. Moreover, its retraction makes it possible subsequently to drop the said bundle downwards.

The top of the conveyor structure 16 is likewise provided with a device 10 which makes it easier to separate bundles from the top of the stack and which is moved by means of a jack 22 and essentially comprises a separating blade 23 and which will be described in more detail below.

The device 5 intended to accompany each bundle in its virtually vertical drop after the separation operation consists of a fork 25 composed of teeth fastened to a crosspiece 26 driven in a vertical to-and-fro cyclical movement in synchronism with the retraction of the support 4. This device 5, too, will be described in more detail later.

A board 7 fitted with free-running rollers is articulated at 29 on the frame 2 at the level of the support 4 and, in its virtually vertical position shown in FIGS. 1 and 2, serves to support the bundles laterally during their virtually vertical drop and at the end of this drop. This board can be raised as a result of rotation about the axle 29 until it reaches a virtually horizontal position, because of the extension of the rod of a jack 27 articulated at its other end on the frame 2 of the machine.

The device for squaring the upright bundles laterally comprises two joggers 28, the position of which is adjustable according to the size of the blanks and the mode of operation of which will be explained later.

Located opposite the board 7 when this is in a virtually vertical position are three skew metal sheets 8 curved as shown, in an arc of a circle slightly widened into a spiral.

The unit 9 for receiving and discharging the bundles is of a type which is new per se. It has the advantage of allowing successive bundles to be received by placing these bundles in a line one behind the other so that they are as close to one another as possible, even if the first bundle of the series remains waiting to be discharged at the downstream end of the unit 9 and even if the bundles arrive on the unit 9 in a random manner. At any moment, the bundle at the front of the line can be discharged alone towards a processing station located downstream and can be replaced, in the waiting position which it occupied, by the second bundle, without impeding the operation in which new bundles arrive at the rear of the line.

The mode of operation of the unit 9 will be explained later by means of the explanatory diagram of FIG. 10, but it is already possible to see from FIGS. 1 to 3 that it comprises:

a table with free-running rollers 30, sloping gently forwards in this example, on which the bundles to be received roll, an endless conveyor 31 intended both for driving the bundles and for retaining them if they descend too quickly and consisting of a driven belt 32 fitted with retention elements consisting, in the example under consideration, of flat flexible claws 33 which, moreover, can be seen better in the side view of the explanatory diagram of FIG. 10. As can be seen in FIG. 3, the conveyor 31 is positioned in the middle of the table 30 and extends approximately over the same length, a motorized conveyor 34 which is adjacent downstream to the table 30 and to the conveyor 31 and which is intended for stopping the leading bundle and discharging it at the desired moment.

Furthermore, the unit 9 as a whole is movable from the front to the rear to allow access to the machine without the need to move it on its wheels 11. For this purpose, the lower side of the table 30 is fitted with a rack 35 engaging on a gear wheel 36 which, as shown diagrammatically in the drawings, is driven by a conventional device with a chain 37, a traction jack 38 and a toothed guide wheel 39.

FIG. 4 is a perspective view of the separation device 10. It comprises a separating blade 23 fitted with teeth, as shown, and carried by a roller 24 which can be driven in a to-and-fro movement as a result of the retraction and extension of the rod of the jack 22, the rod itself being connected to a crank 40 carrying the roller 24 and mounted loosely on the axle of the downstream pulleys of the conveyor 16.

Such a separation device is not new per se and could very easily be replaced by an equivalent device, for example by that described in French Pat. No. 923,939.

Figure 5:
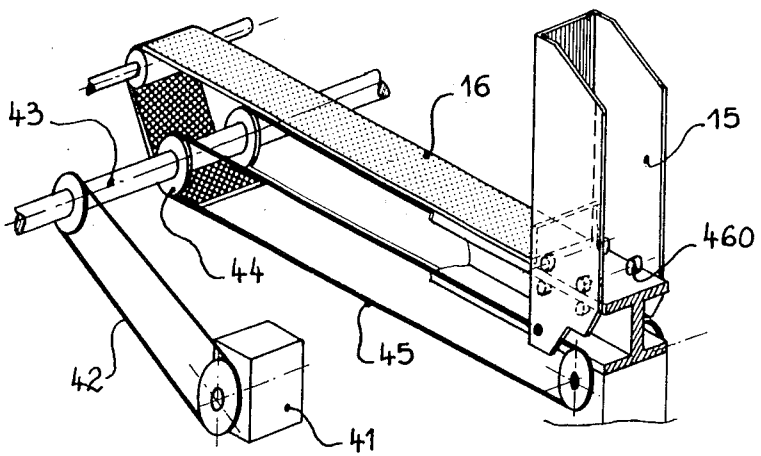
FIG. 5 is a diagrammatic perspective view of one of the elements of the tilting plate, the stack lifter/translator, equipping the machine of the invention.

The perspective view of FIG. 5 makes it possible to understand the way in which the forks 15 can move along the conveyor structure 16. A motor 41 drives, by means of a transmission 42, a shaft 43 and a gear wheel 44, a chain 45 to which the fork 15 is fastened. The fork 15 can roll from the front to the rear on the structure 16 by means of rollers 460 and is integral with the conveyor belt, as illustrated. This device is a direct equivalent of the known devices according to French Pat. Nos. 2,273,656 and 2,359,052 which could very easily be used here.

Figure 6:
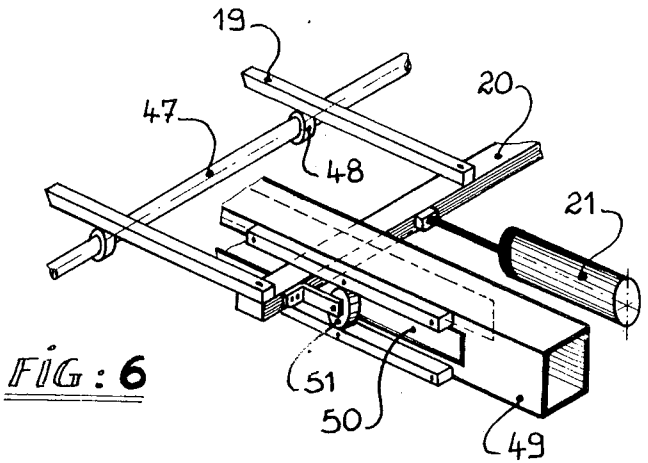
FIG. 6 is a partial perspective view of the retractable stack-top support device associated with the tilting plate of FIG. 5.

FIG. 6 is a partial perspective view of the abovementioned device 4. It comprises forks 19 fastened to a crosspiece 20 and supported at the front by a transverse bar 47 fastened to the frame and fitted with free-running rollers 48 each located under one of the forks. Longitudinal guide elements 49 provided with slots 50 allow the crosspiece 20 to slide longitudinally by means of runners 51 as a result of the retraction or extension of the rod of the jack 21.

FIGS. 7 and 7*a* show respectively in partial perspective and in section according to aa the structure of the support device 5 intended to accompany the bundles at their lower edge in their drop. The crosspiece 26 carrying the two forks 25 is mounted so as to slide on virtually vertical guides 52. The alternating up-and-down movement is imparted, from a motor 53 fastened to the frame, by a conventional transmission of the connecting-rod/crank type comprising a wheel 54, a first articulated connecting rod 55 and a second articulated connecting rod 56. One of the ends of the connecting rod 56 is articulated on the frame of the machine, and its other end is mounted to slide along the crosspiece 26 by means of a bearing roller 57.

Figure 8:
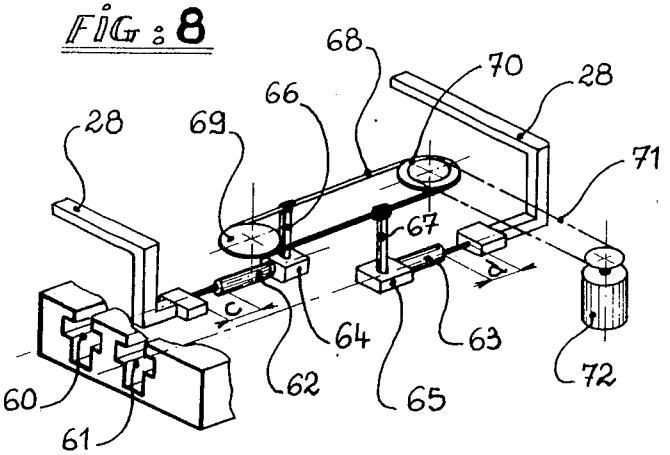
FIG. 8 is a diagrammatic perspective view of the lateral-squaring device with joggers, equipping the machine of the invention.

The device 6 for squaring the bundles laterally after their drop is shown diagrammatically in FIG. 8. It comprises two conventional joggers 28, the bases of which can slide in two parallel slideways 60, 61 fastened to the frame of the machine. The said bases are fastened at the end of the rods of two jacks 62, 63 which are located in each of the slideways 60, 61 and which are retained in these slideways by sliding pieces 64, 65 each provided with a vertical rod 66, 67, the end of which projects from the said slideways.

The projecting ends of the rods 66, 67, are fastened, as illustrated, to the two parallel sides of an endless chain 68 wound round two gear wheels 69, 70, the pivot bearings (not shown) of which are connected to the frame. The wheel 70 is driven in rotation by means of a transmission 71 and a motor 72 fastened to the frame.

According to the lateral size of the blanks, the position of the supports 64, 65 of the jacks 62, 63, the latter having their rods extended in the position of rest, is adjusted by rotating the wheel 70 a sufficient amount in one direction or the other. The position of the jogging jacks 62, 63 is selected in the position of rest. The position of the jogging jacks 62, 63 is selected so that the distance between the joggers is greater than the lateral size of the blanks by an amount equal to or slightly less than the sum (c+d) of the strokes of the rods of the jacks 62, 63. Thus, the sudden retraction of the rods of the said jacks makes it possible to square the bundle of blanks laterally as a result of the action of the joggers 28.

Figure 9:
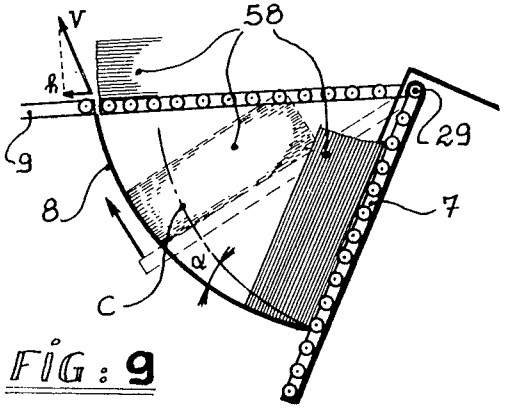
FIG. 9 is a very diagrammatic side view of the device for raising the bundles into a horizontal position, equipping the machine of the invention.

The diagram of FIG. 9 makes it possible to explain the action of raising a bundle 58 to a horizontal position after it has been squared laterally by means of the device of FIG. 8.

As can be seen in the drawing, the skew metal sheet 8 has a concavely curved form widened into a spiral at an angle relative to the arc of circle C with center 29.

When the table 7 rises by pivoting about its axle 29, it carries with it the bundle 58, the edge of which slides on the skew metal sheet 8, thereby advancing progressively along the spiral formed by this metal sheet. When the table 7 ends its travel and reaches the virtually horizontal position shown in FIG. 9, in actual fact sloping slightly downwards and in a downstream direction, the unit 9 already being in this position, the bundle 58 is driven by a speed vector V, the horizontal component h of which is not zero. This component h makes it possible to impart to the bundle 58 a preacceleration in the direction of the receiving unit 9.

As can be seen in FIG. 10, in which the forward slope of the endless conveyor 32 of the unit 9 has been greatly exaggerated, the bundle 58 subsequently descends along the conveyor 32 and from the table with free-running rollers 30 (FIG. 3), and its travel is held back there by the claws 33. The endless conveyor 32 is driven in continuous rotation by the motor 73 fastened to the frame of the unit 9 and by the transmission 74. Its rotation can be stopped, for example to provide a spacing between the bundles.

The bundle 58 is subsequently stopped at 59 on the motorized conveyor 34. The conveyor 34 is an ordinary conveyor with belts, motor driven, as shown, by means of the motor 75 fastened to the frame of the unit 9 and by means of the transmission 76. The stop to wait for the bundle 59 to be discharged at the end of the conveyor 34 is triggered as a result of the stopping of the latter because a photoelectric cell 77 is cut off by the front of the bundle 59. It would be seen that it is then possible to amass in a line behind the leading bundle 59 as many bundles 58 as it is possible to amass in terms of dimensions, whilst the bundle 59 remains waiting to be discharged on the conveyor 34, this being impossible with conventional devices known hitherto.

Of course, the various stages of operation of the machine are interconnected by conventional means (not shown) consisting of photoelectric cells and limit switches, and the like, such as those described, for example, in the abovementioned French Pat. No. 2,359,052 relating to a semi-automatic machine.

The mode of operation of the machine just described will now be explained with reference to FIG. 2 and FIGS. 11 to 15.

In FIG. 2, a stack of cardboard blanks 13, for example coming from a corrugating machine, is delivered in an upright position on the delivery conveyor 12. The tilting plate 3 is then in the upright position, as shown by broken lines, so that it can receive the stack, illustrated at 14, on its four forks 15 which are in the low position and inserted in the conveyor 12.

The rod of the jack 17 is then extended, thus causing the plate 3 to tilt about its axle 18, until it reaches the virtually horizontal position, sloping slightly to the rear, indicated by unbroken lines in FIG. 2. Because of the step provided between the downstream end of the conveyor structure 16 and the forks 19, then in the extended position, some sheets already fall from the top of the stack so as to stand on their edge on the retractable support 4, as illustrated in FIG. 2.

Figure 11:
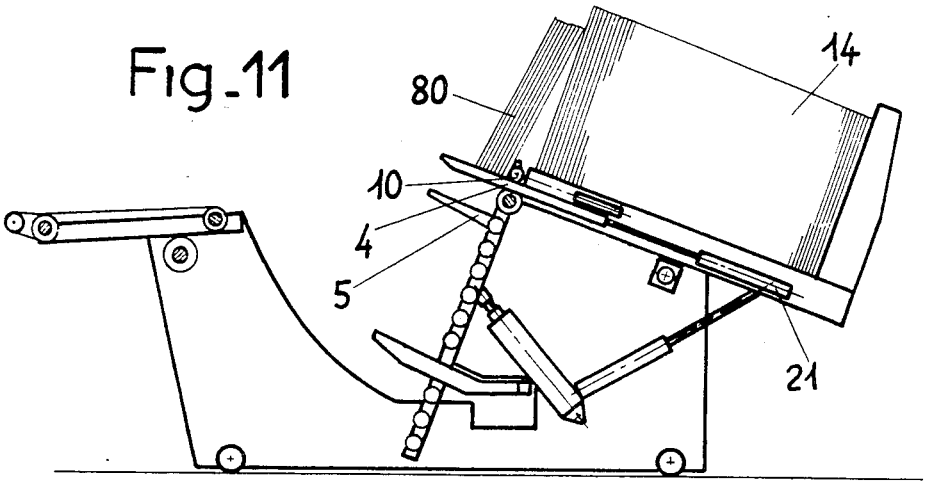
FIGS. 11 to 15 illustrate, in conjunction with FIG. 2 of which they are a continuation, the successive stages of forming and transferring the bundles of sheets from the stack to the delivery station.

The roller (24, in FIG. 4) of the separator 10 is then rotated approximately half a revolution in an anticlockwise direction, thus allowing the blade 23 (FIG. 4), in combination with a slight lifting action attributed to the roller 24 and, if appropriate, to free-running rollers (78, 79 in FIG. 3) optionally mounted on the same axle, to be introduced between two sheets so as to separate a bundle (80 in FIG. 11) cleanly from the top of the stack 14 exactly in the same way as in French Pat. No. 923,939 mentioned above. The separated bundle 80 then rests substantially upright on its edge on the retractable support 4, as can be seen in FIG. 11. Moreover, the device 5 intended to accompany the drop of the bundles is in its uppermost position.

Figure 12:
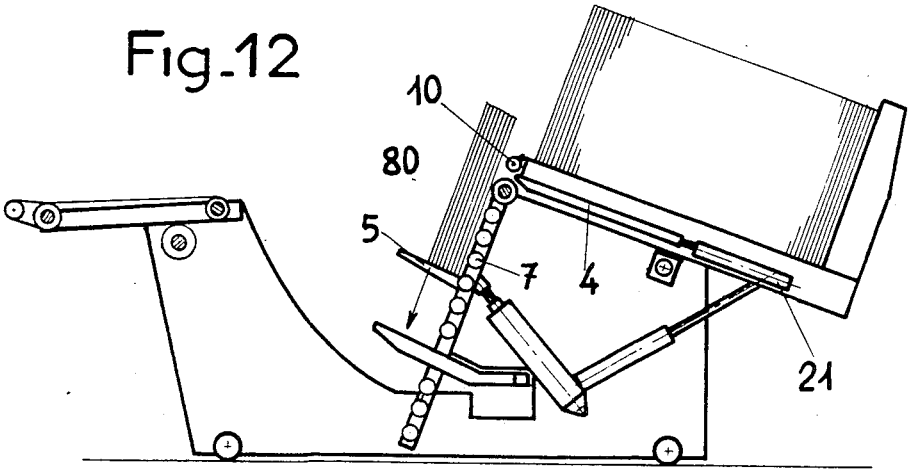

The support device 4 is then retracted suddenly as a result of the retraction of the rod of the jack 21, as shown in FIG. 12, so that the bundle 80 drops down along the table 7. It is accompanied in its fall by the simultaneous descent of the accompanying device 5.

Figure 13:
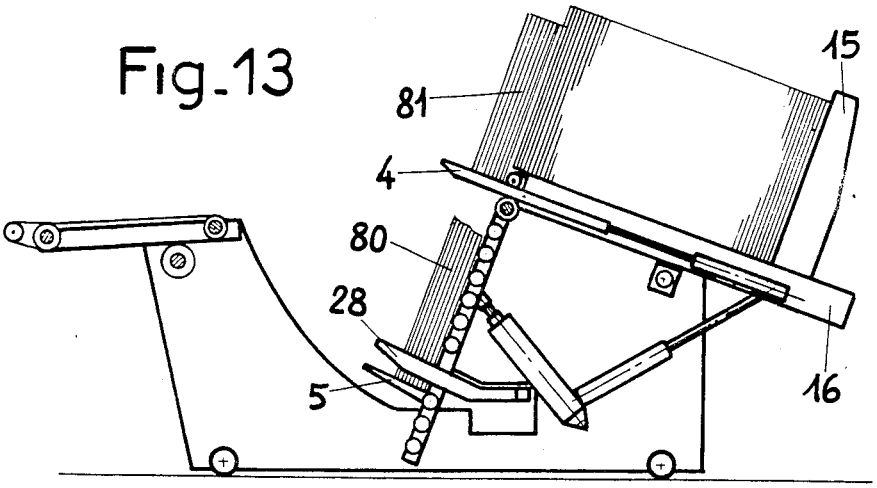

As can be seen in FIG. 13, the virtually vertical drop of the bundle 80 stops when the accompanying device 5 also stops in its lowest position. The bundle 80 is then still approximately upright on its edge, as shown, and the two brackets 28 are then actuated, and these ensure that the bundle is easily squared laterally since it is standing on its edge. During this time, the forks 15 are advanced along the structure 16 a calibrated amount sufficient to allow a new bundle 81 to be separated subsequently, the support 4 of course having previously been extended and the blade 23 of the separator 10 drawn back towards the rear.

Figure 14:
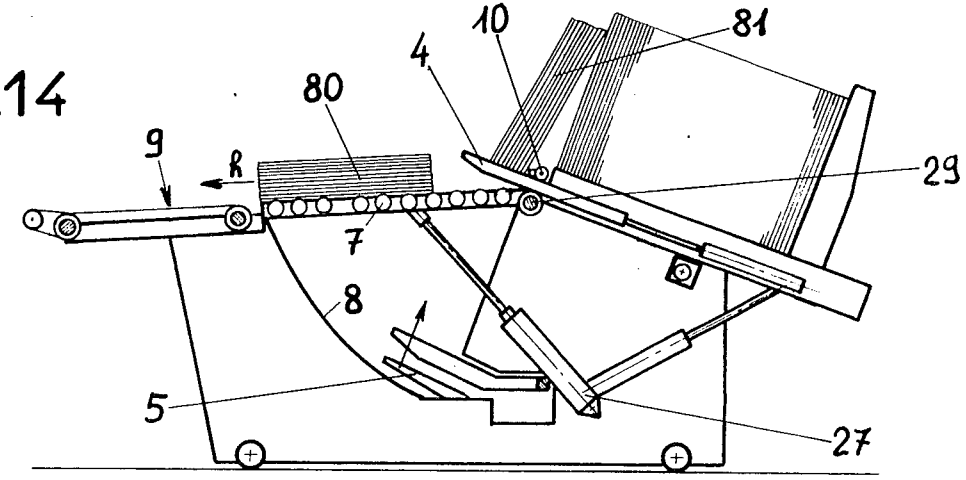

With reference to FIG. 14 and, moreover, to what has been said in relation to FIG. 9, the bundle 80 is raised as a result of the extension of the rod of the jack 27, thus allowing the table 7 to rotate upwards about its hinge-pin 29. As mentioned above, the table 7 then stops in a virtually horizontal position, sloping slightly forwards and in alignment with the slope of the unit 9. As shown above, the shape of the metal sheets 8 imparts an initial acceleration h in the direction of the receiving unit 9.

Figure 15:
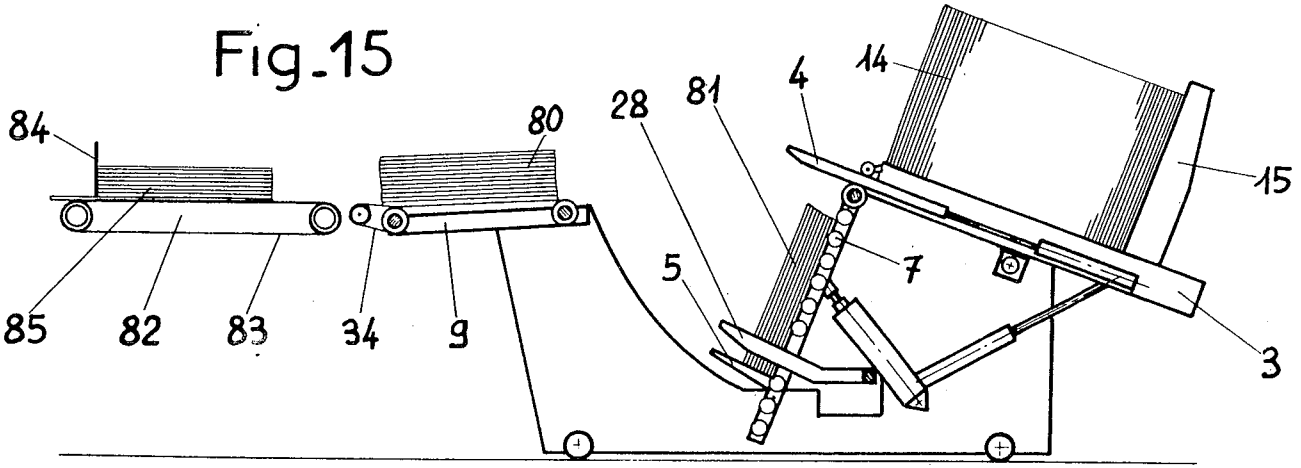

The bundle 80 subsequently descends along a gentle slope on the unit 9 according to the diagram of FIG. 10 explained above, and finally stops on the conveyor 34, as can be seen in FIG. 15. At the same time, the rod of the jack 27 retracts, and the table 7 is lowered again to its initial virtually vertical position.

In the meantime, the separation device 10, which had returned to its original position, has been activated again, so that a new bundle (81 in FIG. 14) has been separated from the top of the stack.

The support 4 is retracted again, thus causing the bundle 81 to drop to its low position shown in FIG. 15, in which it is squared laterally by the brackets 28.

Because of the dimensions of the bundles and the unit 9 illustrated in the drawings, there is only room for a single bundle 80 on the unit 9. The bundle 81 therefore remains in its position shown in FIG. 15, waiting to be raised to a horizontal position, until the bundle 80 is discharged by the conveyor 34. With smaller sheet sizes, there could be room on the unit 9 for several bundles in a line behind one another, so that the table 7 could be raised to a horizontal position to discharge the bundle 81 onto the unit 9, and it would be possible to handle at least one more bundle coming from the top of the stack.

Following the conveyor 34, there is a conventional delivery station 82 with a motorized conveyor 83 and a limit stop 84. Such a device, which per se does not form an integral part of the invention, resembles, for example, that described in French Pat. No. 2,313,294 mentioned above.

When the preceding bundle 85, being handled on the delivery station 82, is discharged completely sheet by sheet, for example towards the magazine of the "slotter printer", the conveyor 37 is started up, thus allowing the bundle 85 to be replaced by the bundle 80 on the delivery table. The table 7 is then raised, and the bundle 81 replaces the bundle 80 on the receiving unit 9. The operations continue in this way until the stack 14 is exhausted. The forks 15 are then brought to the rear, whilst the plate 3 is tilted rearwards into its upright position, to receive a new stack which again is handled in the same way as the stack 14. Because in all at least three bundles, such as the bundles 81, 80 and 85 of FIG. 15, are being handled, there is time for this stack changing operation to be carried out, without the risk of an interruption in the supply of sheets to the slotter printer.

The device which has just been described makes it possible to separate and process bundles 80, the thickness of which does not exceed a few tens of a centimeter, to give an idea of the actual conditions.

It is possible, by means of this machine, to process thicker bundles, since the lateral squaring of a bundle standing on its edge is carried out quite easily. In this case, the forks 25 equipping the accompanying device 5 are advantageously replaced by a conveyor with belts, which are motorized at least in the upper position of this conveyor, and of sufficient length. In this case, the retractable support 4 can be omitted since the processing of successive bundles may be slower. Of course, it is also possible to omit the retractable support 4 in the machine of FIG. 1, when a lower operating speed is acceptable.

To bring each stack of cardboard sheets in an upright waiting position up to a machine according to the invention, it is increasingly common to use conveyors with motorized rollers (12 in FIG. 2), coming within the scope of general automation of the factory which is increasingly desirable at the present time.

Nevertheless, the disadvantage of these roller conveyors is that they flatten and stain the bottom sheet of the stack. Such a sheet which is flattened and soiled in this way is undesirable as regards the presentation of a printed and folded cardboard case, but in itself this would not be too serious because it would be sufficient to supply the user with an additional case per stack; however, it is also detrimental to the operation of the case-making machine which it risks blocking by creating a "jam", that is to say an obstruction at the location where the sheets are introduced one by one into the slotter printer. In fact, the limiting knives are adjusted in terms of height so as to allow a sheet of normal thickness to pass and prevent two of these sheets from passing. Consequently, there is, without doubt, a space between the sheet which passes under the knives and the base of these, so that there is a great chance that the latter sheet of less thickness will manage to be introduced under the limiting knives at the same time as the preceding sheet, thus more often than not causing the two sheets to be wedged under these knives and consequently causing the machine to stop.

According to an alternative form of the invention, it is possible to mitigate these disadvantages by means of an additional operation involving the automatic separation and elimination of the last sheet of the last bundle of each stack, that is to say the sheet from the bottom of this stack. More particularly, it involves delaying the last sheet of this last bundle during the virtually vertical drop of the latter, retaining this last sheet during the operation of discharging this bundle, and then eliminating this last sheet by discharging it along a different path.

Reference will now be made to FIGS. 16 to 26 which describe diagrammatically the mode of operation and construction of an additional device making it possible to separate and eliminate the last sheet of each stack automatically.

Figure 16:
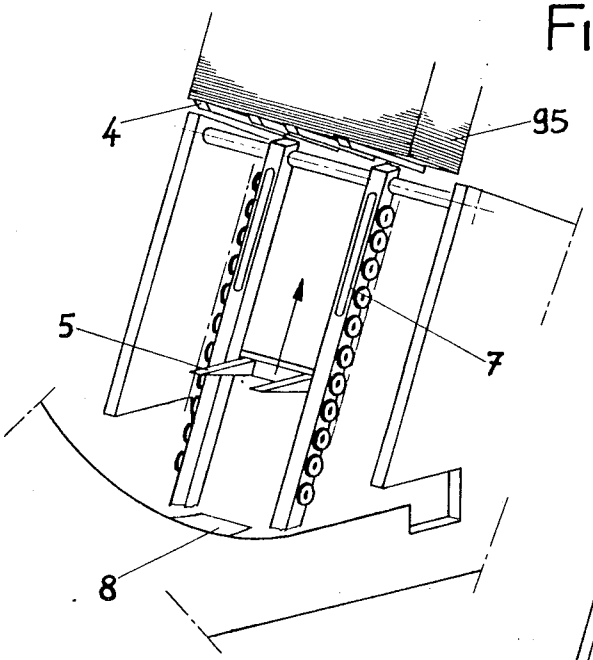

FIG. 16 shows the last bundle of a stack, such as the stack 14 of FIG. 2, in an upright position on the retractable support 4. The accompanying device 5 is being raised towards its uppermost position. The presence of the last bundle 95 on the support 4, triggering the operation of eliminating the last sheet, which will be described, is detected by the automatic mechanism controlling the running of the machine by means of a coder or a contactor (not shown) located at the downstream end of the conveyor structure 16.

Figure 17:
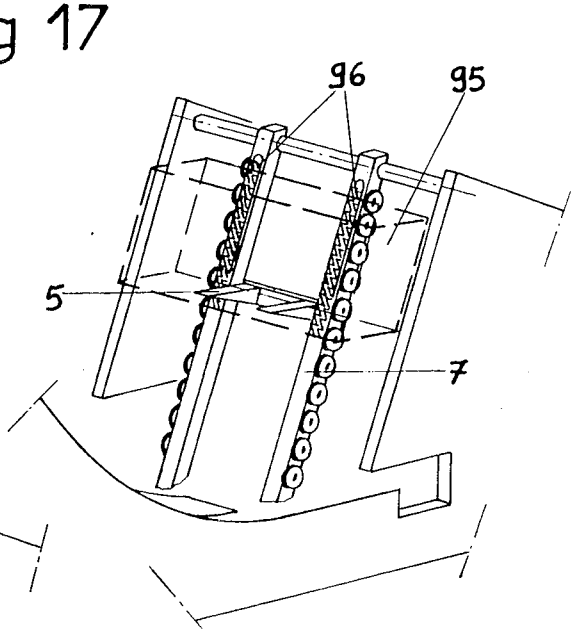
FIGS. 16 to 23 illustrate the successive stages of operation of a device for eliminating the last sheet automatically from each stack, which can equip the machine of the invention.

The support 4 is then retracted, and the last bundle 95 starts its virtually vertical drop, being accompanied in this by the accompanying device 5. However, this time, the accompanying device 5 is stopped on its way, approximately half-way along its usual travel, and together with it stops the bundle 95, as can be seen in FIG. 17.

Two catching strips with saw teeth 96, till then retracted beneath the level of the free-running rollers equipping the lifting table 7, are then extended in such a way that their teeth engage in the last sheet of the bundle 95, thus immobilising it.

Figure 18:
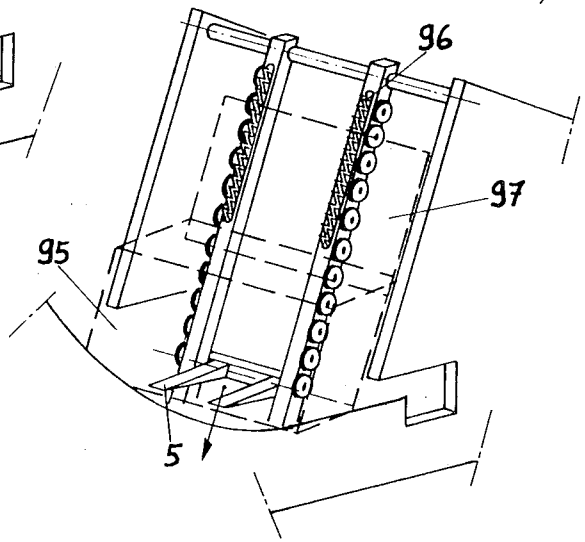

Then, as indicated in FIG. 18, the brake of the motor (53 in FIG. 7) driving the accompanying device 5 is released, so that the bundle 95 completes its virtually vertical drop, of course with the exception of the last sheet 97 which remains caught on the strips 96.

Figure 19:
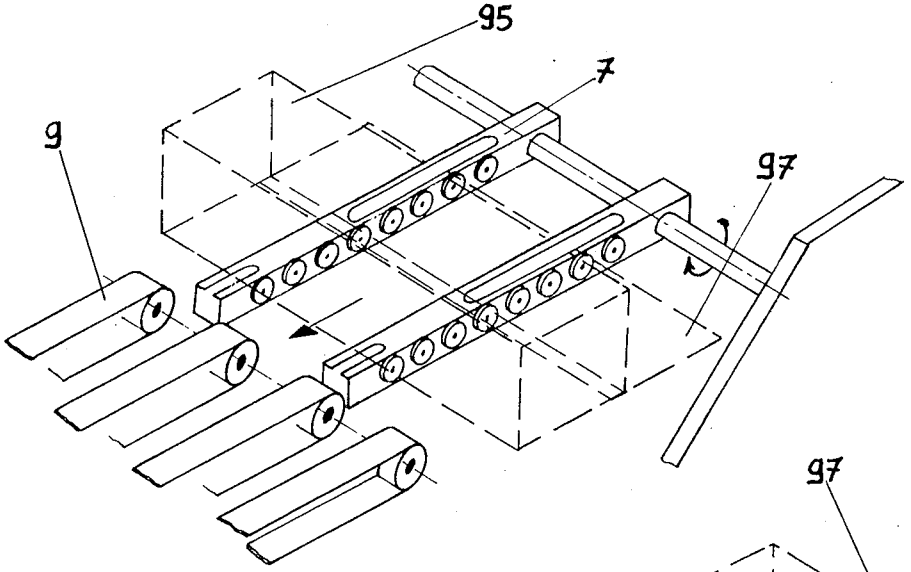

The strips 96 are then retracted and, as indicated in FIG. 19, the assembly consisting of the bundle 95 and its last sheet 97 offset to the rear is taken up in the movement of raising the table 7 into the virtually horizontal position. When the latter has reached its top dead center, the assembly consisting of the bundle 95 and the offset sheet 97 descends along a gentle slope towards the receiving and discharge unit 9 represented here by a belt conveyor.

Figure 20:
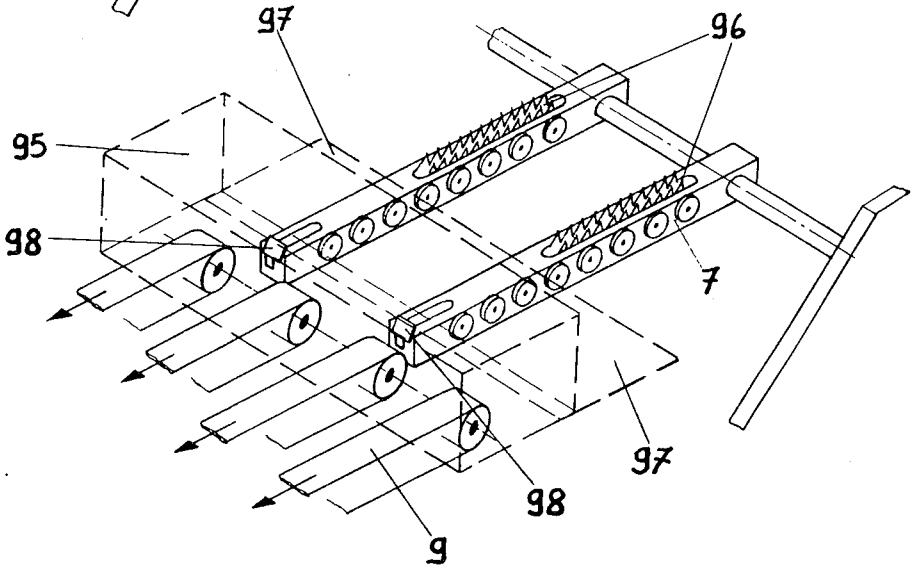

Then, as indicated in FIG. 20, when the bundle 95 is engaged on the receiving unit 9 an amount slightly less than the offset between this bundle 95 and the last sheet 97, this value being detected by a coder or a contactor (not shown) located on the unit 9, the catching strips 96 are extended again, and, as will be seen below with reference to FIG. 26, this causes two claws 98 to project simultaneously downstream of the table 7 and to bear slightly under the lower face of the last sheet but one of the bundle 95. The bundle 95 continues its travel on the unit 9, but the last sheet 97 remains on the table 7, stopped in its forward travel by the two claws 98.

Figure 21:
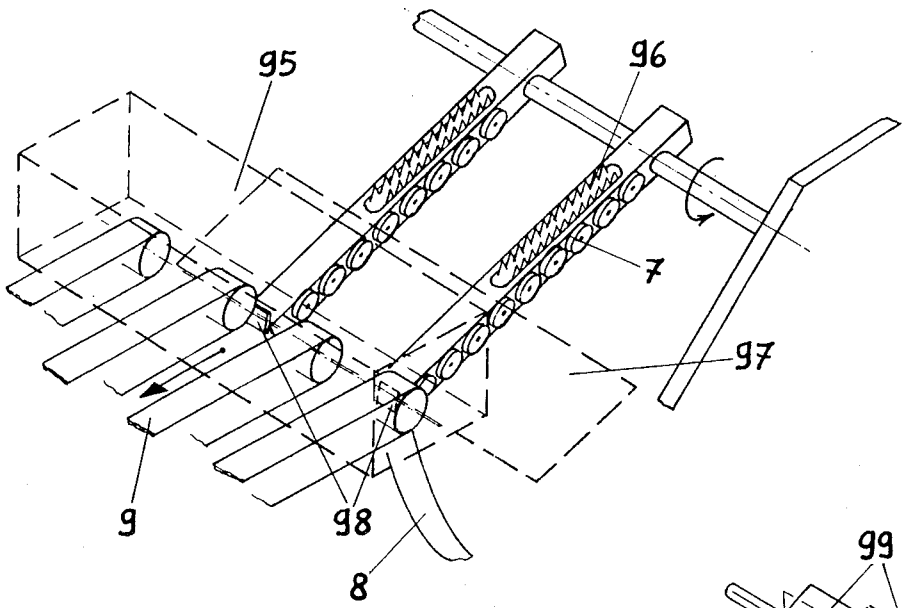

As can be seen in FIG. 21, when the bundle 95 is engaged on the unit 9 a sufficient amount to ensure its stability on the unit 9, for example an amount which is equal to two-thirds of its width and which is detected by a contactor (not shown) located on the unit 9, the table 7 is lowered again, carrying with it the sheet 97.

Figure 22:
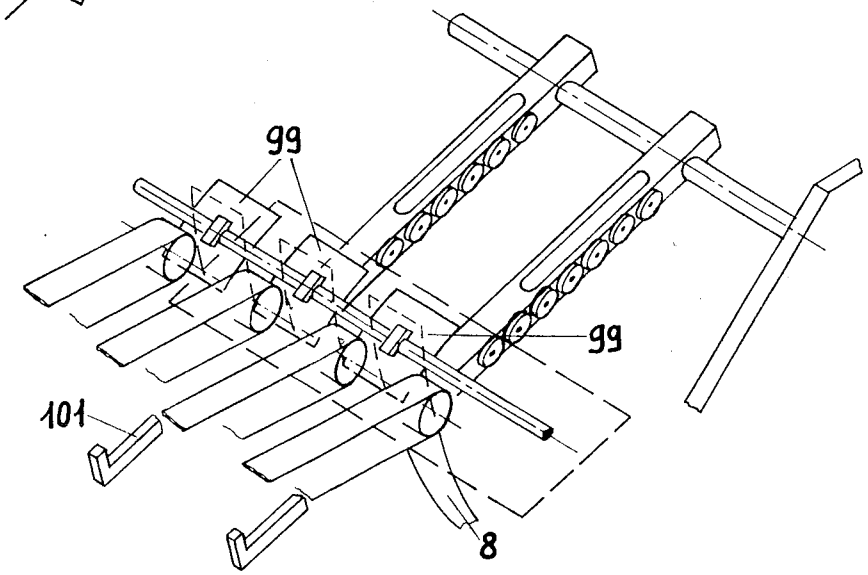

However, this time, the table 7 does not descend completely to the bottom. As indicated in FIGS. 22 and 23, it is immobilised, at approximately a third of its travel, opposite flaps 99, the tilting of which then makes it possible to provide an aperture 100 in the skew metal sheets 8.

The claws 98 are then retracted, thus allowing the sheet 97 to descend towards a storage magazine 101 for these last sheets or towards a discharge device, such as a cross-conveyor, or a destructor device, such as a crusher.

Figure 23:
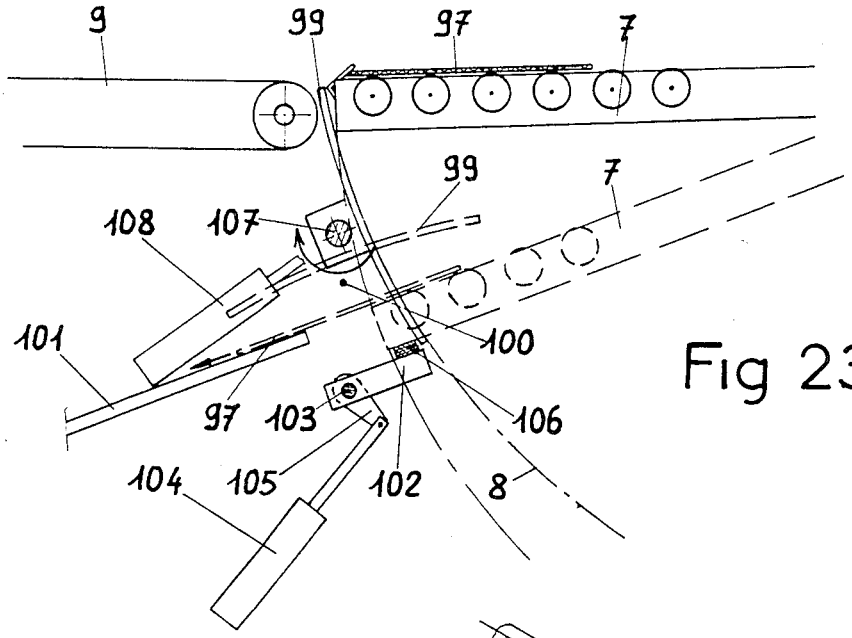
Figure 24:
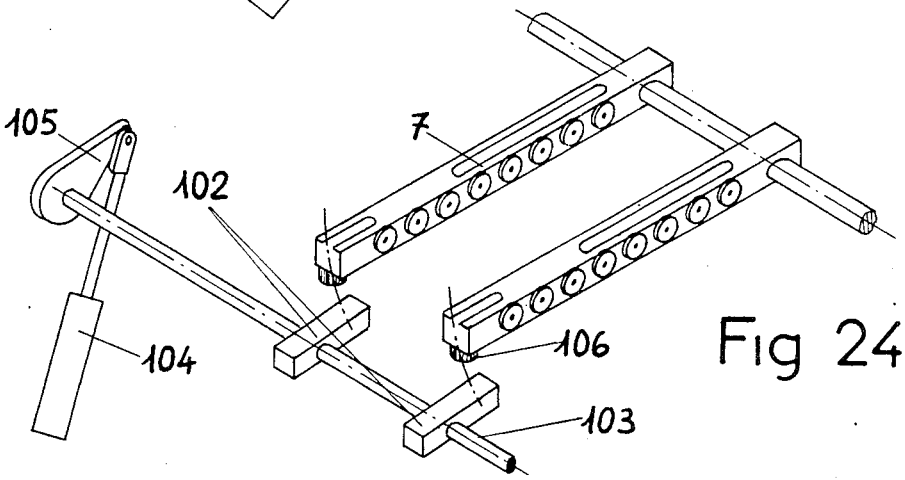
FIG. 24 is a perspective view of the device for stopping, in the intermediate descent position according to FIGS. 22 and 23, the table for raising to a horizontal position, equipping the machine of the invention.
Figure 25:
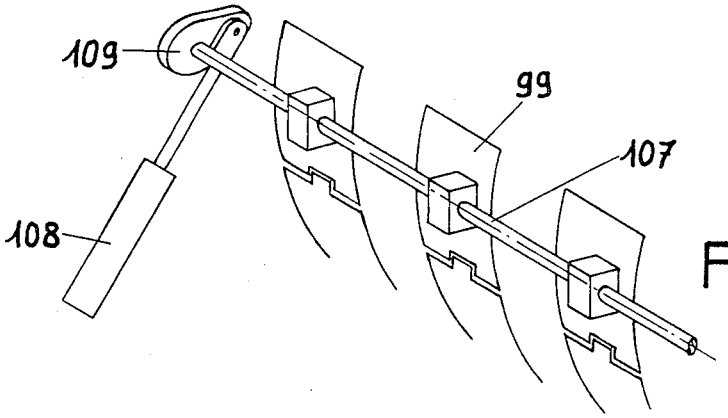
FIG. 25 is a perspective view of the device with tilting flaps which makes it possible according to FIGS. 22 and 23, to discharge the last sheet.

FIGS. 23 to 25 make it possible to understand the construction and installation of the device controlling the tilting of the flaps 99 and of the device stopping the table 7 opposite these flaps.

As can be seen in FIGS. 23 and 24, the table 7 comes up against two bolts 102 fastened to a cross bar 103 which can rotate on itself a quarter of a revolution under the control of a jack 104 which is articulated on a connecting rod 105 integral with this bar. In the position illustrated, the rod of the jack 104 is extended, and the bolts 102 stop the descent of the table 7 which because of this carries elastic stops 106. As a result of the retraction of the rod of the jack 104, the bolts 102 are rotated downwards and therefore moved away, thus allowing the table 7 to complete its descent.

Referring now to FIGS. 23 and 25, the flaps 99 are also fastened to a cross bar 107 which can rotate a quarter of a revolution under the action of a jack 108 articulated to a connecting rod 109 integral with the bar 107. In the position illustrated in FIG. 25, the rod of the jack 108 is extended and the flaps 99 are closed. As a result of the retraction of the rod of the jack 108, the bar 107 is rotated a quarter of a revolution in a clockwise direction, and the flaps 99 are consequently opened.

Figure 26:
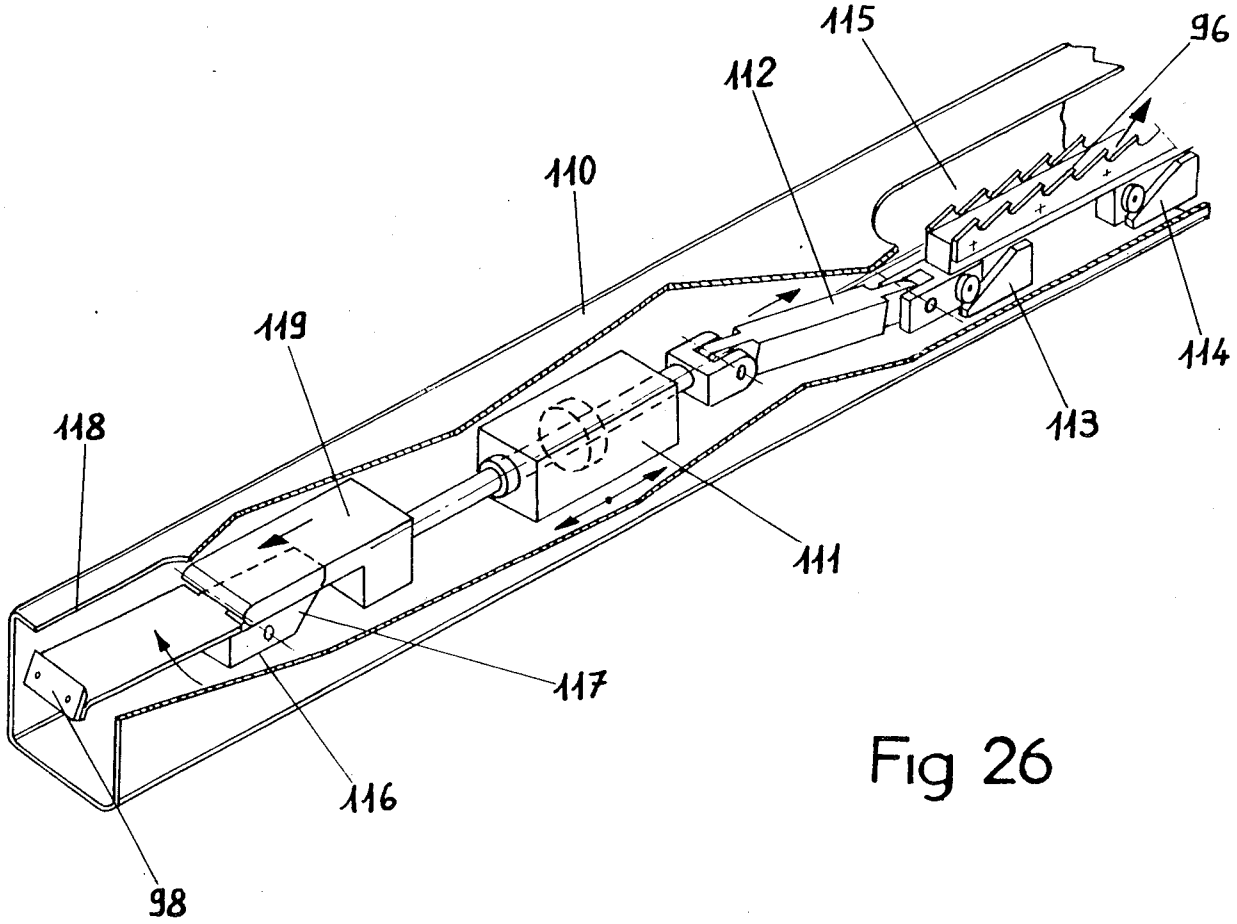
FIG. 26 is a perspective view of the device for offsetting and retaining the last sheet, equipping the automatic elimination device according to FIGS. 16 to 23.

FIG. 26 illustrates the construction and installation of one of the devices with a paired catching strip 96 and claw 98. This device is located in the very structure 110 of the lifting table 7. As can be seen in the drawing, the movement of the catching strip 96 is imparted by a jack 111 with a double rod, which, by means of an articulated connecting rod 112, pushes the strip 96 on two slopes 113, 114, thus giving it a vertical movement which makes it project from its receptacle 115. Moreover, the claw 98 is fastened so as to be articulated about a transverse pin 116 and is associated with a counterweight 117 which normally makes it project from its receptacle 118. A bolt 119 integral with the other rod of the jack 111 makes it possible, as a result of its translational movement towards the claw 98, to retract the latter into its receptacle 118.

As can be seen in the drawing, the extension and retraction of the strip 96 and the claw 98 take place simultaneously.

The machine which has just been described does not allow the bundles to be turned over before they are delivered sheet by sheet. It is ideally designed for supplying the magazine of the feeder of a "slotter/printer" using a printing press which prints from the bottom.

If, on the contrary, a printing press which prints from the top is used, it is necessary to turn over the bundles before extracting the sheets from them one by one. A slightly modified machine will then be used, and this will now be described with reference to FIGS. 27 to 31.

Figure 27:
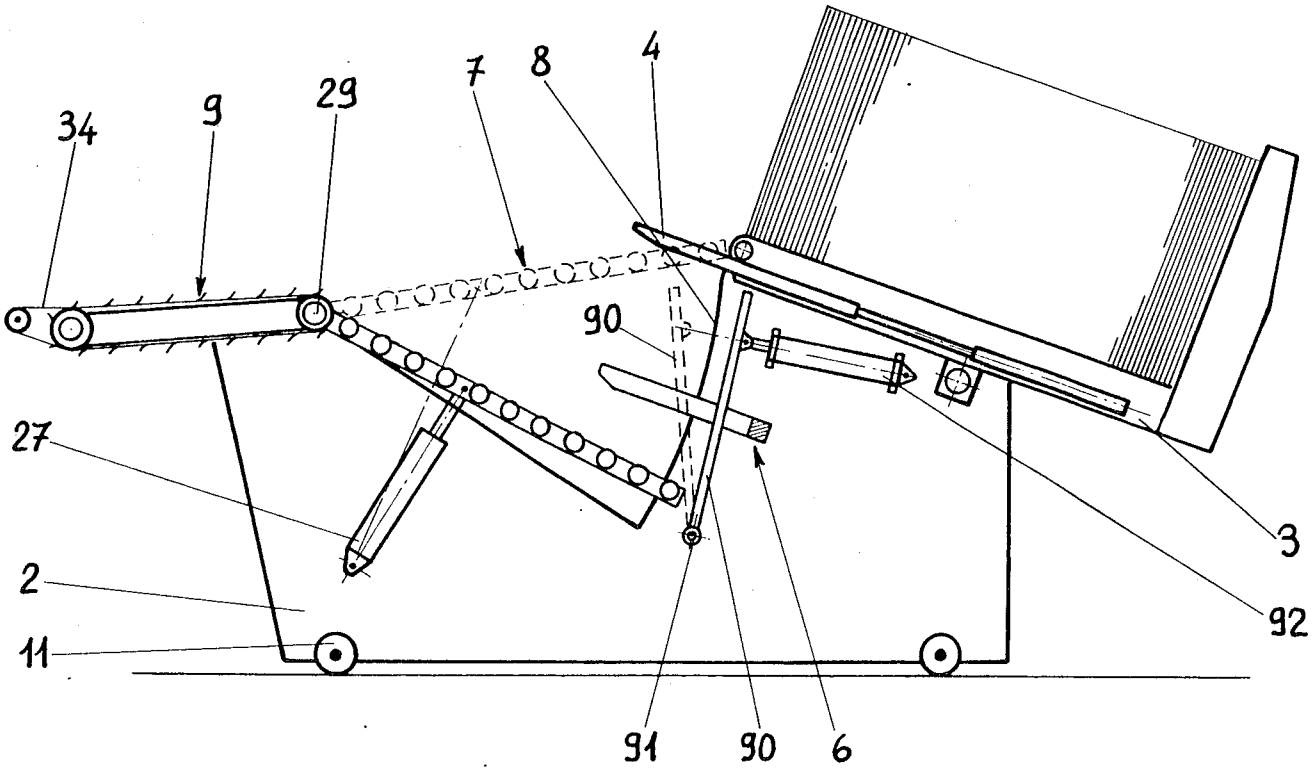
FIG. 27 is a diagrammatic representation in a side view of an alternative embodiment of the machine according to FIGS. 1 to 10, incorporating a device for turning over the bundles.

FIG. 27 is a highly diagrammatic side view of this alternative form. It has, as before, the frame 2, the tilting plate 3, the retractable support 4, the lateral-squaring device 6 and the receiving and discharge unit 9. On the other hand, as can be seen in the drawing, the positions of the lifting table 7 and the skew metal sheets 8 are the opposite of those in the machine shown in FIG. 2, and the metal sheets 8 have the form of an arc of a circle which is slightly narrowed into a spiral, instead of being widened into a spiral as before. The axis of rotation 29 of the table 7 and its control jack 27 are shifted downstream, as can be seen in the drawing. The device 5 accompanying the drop of the bundles is not shown, because its function can be performed by the table 7 itself, as will be seen below.

Moreover, the machine of FIG. 27 incorporates a device for turning over the bundles, consisting of one or more rods 90 which are articulated at the bottom about an axle 91 passing between two metal sheets 8 and which can be driven in a movement from the rear forwards as a result of the extension of the rod of a jack 92 articulated on the frame 2 of the machine. The forward tilting of the flat rod 90 makes it possible to give the bundle, after it has fallen along the metal sheets 8 and stopped upright on its edge, a push which tips it onto the table 7, thus allowing it to be turned over, as will now be seen with reference to FIGS. 28 to 31 which indicate diagrammatically the mode of operation of the apparatus of FIG. 27.

Figure 28:
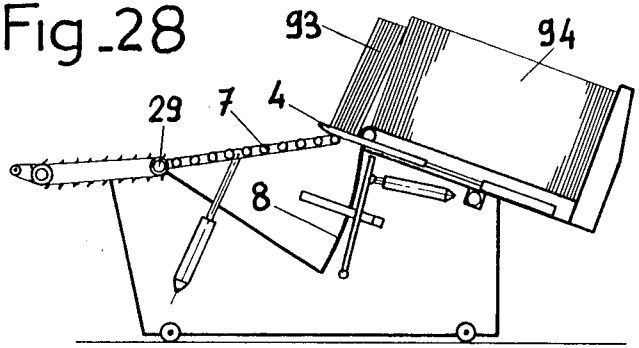

In FIG. 28, a bundle 93 has been separated from a stack 94, in the same way as the embodiment of FIG. 2, and rests on the retractable support 4. The table 7 is raised into its upper position, as illustrated, as a result of rotation about its axis 29 which is located downstream in this case.

Figure 29:
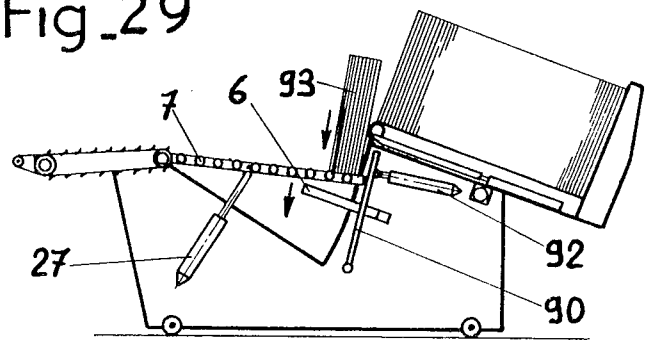
FIGS. 28 to 31 illustrate the successive stages of operation of the machine shown in FIGS. 27.

FIG. 29 shows the following operation, during which, the support 4 being retracted, the bundle 93 falls down, accompanied in its drop by the descent of the table 7 caused by the retraction of the rod of the jack 27. The squaring device 6 is then actuated in the same way as in the preceding machine.

Figure 30:
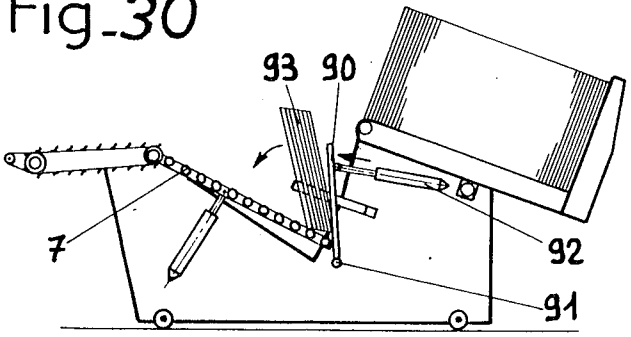

With reference to FIG. 30, the jack 92 is then actuated by extending its rod, so that the rod 90 rotates about its axis 91 and gives the bundle 93 a lateral push which tips it onto the table 7 which at this moment is in the lowest position.

Figure 31:
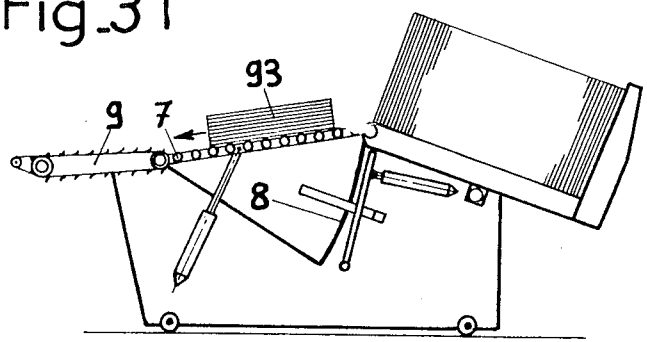

Subsequently, as shown in FIG. 31, with the rod of the jack 92 being retracted, the table 7 is raised into a virtually horizontal position, sloping down slightly in a downstream direction, as before. The bundle 93 is subsequently received by the unit 9 as before, and the cycle begins again.

All the practical examples described above result, as can be seen, for example, in FIG. 15, in supplying the magazine of the feeder equipping the case-making and printing machine or slotter/printer, located after the machine of the invention, by means of a sheet-by-sheet delivery station with a motorized conveyor and a limit stop. The disadvantage of using such a delivery station between the machine of the invention and the magazine of the feeder is that it substantially increases the length of the machine, often giving rise to an overall size which is prohibitive in some cardboard factories.

An alternative embodiment which will now be described incorporates a different form of the bundle receiving and discharge unit 9, of a type which is new per se and avoiding this kind of disadvantage, because it makes it possible to empty the bundles leaving the machine of the invention directly into the magazine of the input feeder of the slotter/printer or other sheet-processing machine. According to this alternative embodiment, the bundle receiving and discharge device 9 comprises:

at least a first motorized endless conveyor associated with at least one independent and retractable stop for stopping at least one bundle located on this conveyor, at least a second motorized endless conveyor following the first and associated at its downstream end with free-running means for rolling the bundle on these means, retractable means making it possible to push the rear of the bundle, making it roll on the said free-running rolling means.

Figure 32:
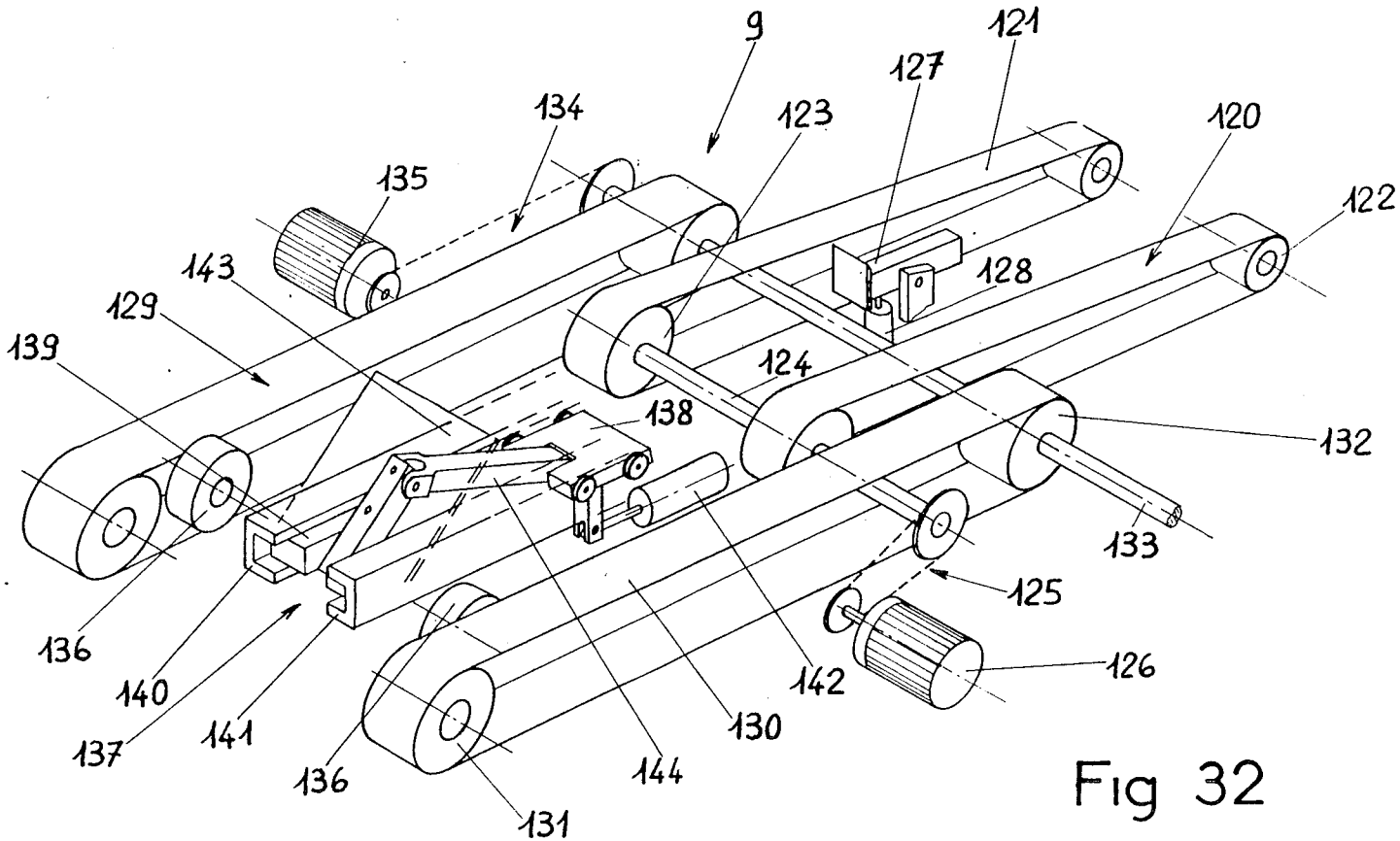
FIG. 32 is a perspective view of another embodiment of the device for receiving and discharging bundles, equipping the machine of the invention.

FIG. 32 illustrates an example of a bundle receiving and discharge unit 9, which is substantially different from that described above and which makes it possible to put this alternative embodiment into practise.

The unit 9 shown diagrammatically in FIG. 32 comprises:

a first entirely conventional endless conveyor 120 consisting of two endless belts 121, each rotating between two pulleys 122, 123, these belts being driven by means of a shaft 124 connecting the downstream pulleys 123, this shaft itself being driven, via a conventional transmission 125 with pinions and a chain, by an electric motor 126 fastened, like the rest, to the frame of the unit 9, not shown in this drawing.

Moreover, an articulated stop 127 is located between the belts 121, so that, under the action of a vertical jack 128 itself fastened to the frame of the unit 9, it can project above the plane formed by the upper sides of the belts 121 and, of course, can be retracted below the level of this plane, still under the action of the jack 128.

a second endless conveyor 129 which follows the conveyor 120, as can be seen in the drawing, and which likewise comprises two endless belts 130, each rotating between two pulleys 131, 132, these belts being driven by means of a shaft 133 which, via a transmission 134 with pinions and chains, is driven by an electric motor 135 fastened like the rest, to the frame of the unit 9.

In a way which is customary for two successive conveyors of this type, the level of the plane formed by the upper sides of the belts 130 is slightly above, (a few millimeters to 1 centimeter) the plane formed by the upper sides of the belts 121, thus allowing material to be transferred positively between the upstream conveyor 120 and the downstream conveyor 129.

Located at the level of the downstream end of the conveyor 130, set back slightly from this end, as shown in the drawing, and between the belts 130 and connected to the frame of the unit 9 are two free-running wheels 136 which project slightly, for example one centimeter, above the level of the upper sides of the belts 130.

A retractable pusher 137 located between the belts 130 so as to be retracted below their upper level. As can be seen in the drawing, this pusher consists of two carriages 138 and 139 travelling along two common slideways 140 and 141.

The upstream carriage 138 runs along the slideways 140 and 141 with a low coefficient of friction and is driven in a translational movement by a pneumatic jack 142 fastened, like the rest, to the frame of the unit 9. The downstream carriage slides with a high coefficient of friction along the slideways 140 and 141 and constitutes the hinge of the flap 143 of the pusher, this flap itself being connected to the upstream carriage 138 by an articulated connecting rod 144.

The mode of operation of the pusher 137 is as follows:

When, with the carriage 138 being in the maximum withdrawn position and the assembly therefore being retracted below the upper level of the conveyor 129, the jack 142 pushes the carriage 138 forwards, it subjects the flap 143 by means of the connecting rod 144 to an inclined force, the horizontal component of which is less than the force required to push the downstream carriage 139 along the slideways 140 and 141. The upstream carriage 138 therefore approaches the downstream carriage 139, thus causing the flap 143 to be extended above the upper level of the conveyor 130. When the flap 143 is completely extended and is therefore in a vertical position, the upstream carriage 138 comes up against the downstream carriage 139 and consequently pushes it forwards together with the extended flap 143. The flap 143 is returned and retracted according to the process in reverse, when the jack 142 brings the upstream carriage 138 to the rear.

It would, of course be possible to replace the device 137 just described by a conventional device with an endless chain provided with pusher brackets, but such a conventional device necessitates a considerable bulk towards the bottom, so that this bulk would prevent any person from passing underneath the unit 9, whereas this passage remains possible because of the pusher 137 of the invention which has a low mechanical bulk in terms of height.

The mode of operation of the bundle receiving and discharge unit 9 illustrated in FIG. 32 will now be described with reference to FIGS. 33 to 38.

Figure 33:
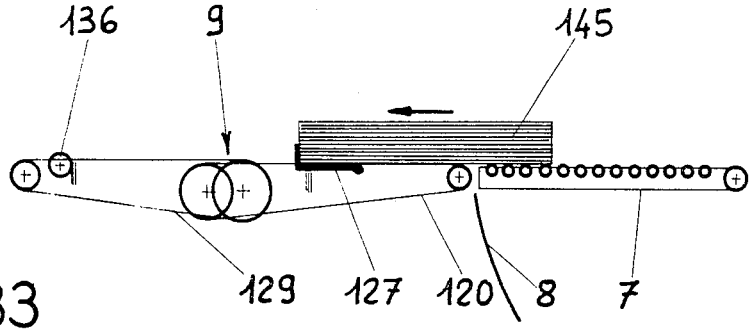
FIGS. 33 to 38 illustrate the successive phases of operation of the device shown in FIG. 32.

FIG. 33 shows diagrammatically the first operating phase of the unit 9 of FIG. 32. After a bundle of blanks 145 has been raised to a horizontal position by the table 7 of the machine according to the invention, this bundle advances in a gentle slope towards the belts of the conveyor 120. The conveyor 120 then draws the bundle 145 along at low speed (for example, of the order of 0.3 m/sec) so as not to deform it, until the stop 127, in the upper position as shown, stops this bundle which is then sufficiently engaged on the conveyor 120 to stay there by itself.

The belts of the conveyor 120 continue to rotate for a few seconds, allowing the sheets from the bottom of the bundle 145, which could have been delayed to a greater or lesser extent during preceding handling operations, to be reintroduced completely under the bundle. A timer (not shown) previously locked during the raising of the table 7, then stops the movement of the conveyor 120.

Figure 34:
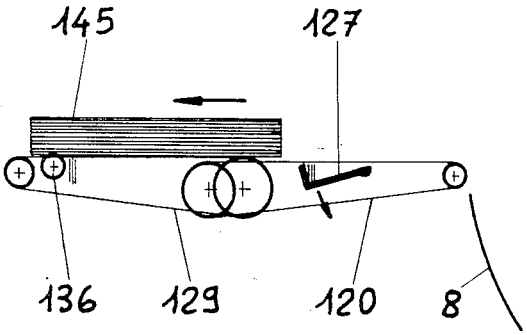

Then, as shown in FIG. 34, since the second conveyor 129 is free, this being detected by a photoelectric cell (not shown), the rod of the jack 128 (FIG. 32) is retracted, so that the stop 127 moves away, and the two conveyors 120 and 129 are started up at low speed (0.3 m/sec), so that the bundle 145 is transferred slowly in the direction of the magazine of the feeder, on the belts of the conveyor 129 and stops at the end of these after its front part has engaged, as shown, on the free-running wheels 136 which project slightly above the level of the conveyor 129. The stopping of the conveyor 129 is triggered by a photoelectric cell (not shown).

Figure 35:
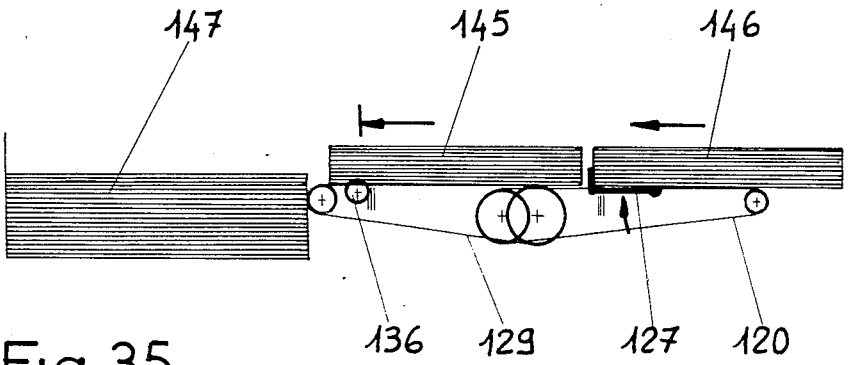

In the meantime, as can be seen in FIG. 35, where the magazine of the feeder has been shown diagrammatically at 147, another bundle 146 has taken its place on the conveyor 120 where it remains waiting, stopped by the stop 127 which is raised, as illustrated.

Figure 36:
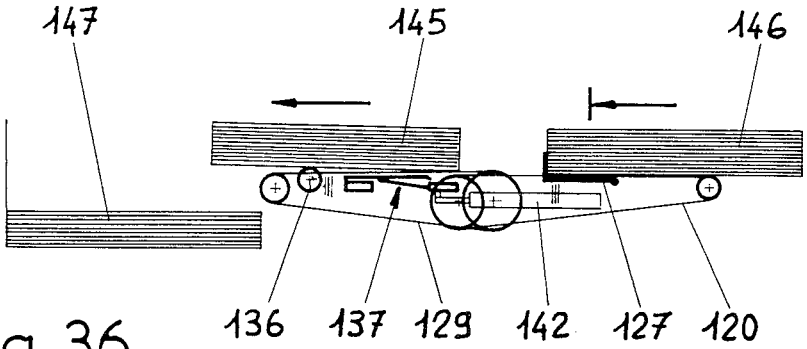

Then, as shown in FIG. 36, when the magazine 147 has been emptied sufficiently to receive the bundle 145, this being detected by a photoelectric cell (not shown), the conveyor 129 is started up again, and the bundle 145 advances towards the magazine 147.

Figure 37:
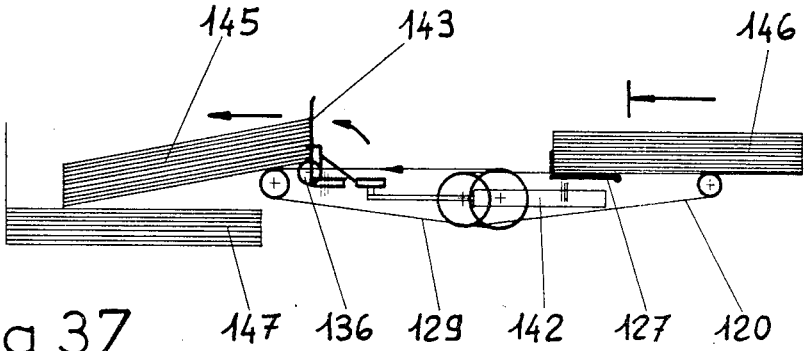

Before the bundle 145 begins to fall into the magazine 147 of the feeder when it is supported less and less on the belts of the conveyor 129, the rod of the jack 142 has extended, so that, as can now be seen in FIG. 37, the pivoting flap 143 extends rapidly and pushes the bundle 145 over the entire height of its rear part, making it roll on the free-running wheels 136 and accelerating it very substantially (from 0.3 m/sec to more than 1 m/sec). The force of inertia attributed to this acceleration makes it possible to maintain the cohesion of the bundle 145 during its fall into the magazine 147 of the feeder.

Figure 38:
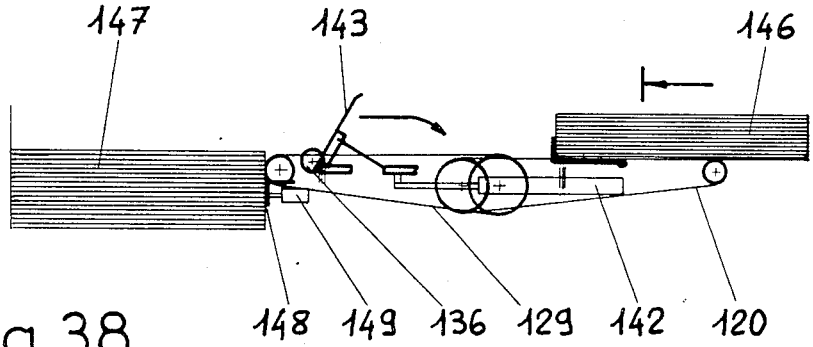

As shown in FIG. 38, the flap 143 is then returned to the rear as a result of the retraction of the rod of the jack 142. It is then retracted and returns to its waiting position under the upper level of the conveyor 129. The longitudinal alignment of the cardboard blanks constituting the bundle just delivered into the magazine 147 is then advantageously completed by a jogger 148 which, driven by a jack 149, pats the rear of the bundle in alternating movements.

Of course, the invention is not limited to the embodiments just described by way of example, but also covers embodiments differing from them only in details, in alternative forms of construction or in the use of equivalent means. Although the method of handling a stack by tilting is preferred and in widespread use at the present time, it is not absolutely essential to lay the stack on its side before extracting from it a bundle standing on its edge. The stack could very easily be maintained in an upright position, as in French Pat. No. 2,313,294 mentioned above, a bundle extracted from it, as in the said patent, and this bundle then laid on its edge by means of a tilting plate similar or identical to the plate 3, but handling only a single bundle, which could subsequently continue to be handled according to the present invention.

We claim:

1. A process for the automatic supply of a machine for processing products in the form of sheets, which involves the following operations:

bringing a waiting stack into the upright position,
inclining this stack until it rests on its side,
separating a bundle of blanks from the top of the stack, the said bundle remaining standing on its edge,
dropping this bundle down until it stops, still standing on its edge,
squaring this bundle laterally,
raising the bundle in a movement bringing it approximately to a horizontal position,
discharging this bundle.

2. A process for the automatic supply of a machine for processing products in the form of sheets, which involves the following operations:

bringing a waiting stack into the upright position,
extracting a bundle of blanks from the top of the stack and positioning this bundle upright on its edge,
dropping this bundle down until it stops, still standing on its edge,
squaring this bundle laterally,
raising the bundle in a movement bringing it approximately to a horizontal position,
discharging this bundle.

3. A process as claimed in claim 2, wherein the said bundle is brought back to a virtually horizontal position by a movement following the arc of a circle, widened or narrowed in a spiral to give it a horizontal pre-acceleration in the direction of discharge.

4. A process as claimed in claim 2, wherein the bundle is lowered, after being brought into a virtually horizontal position, onto a first free-running conveyor equipped with a retaining device, and wherein the said bundle is stopped on a second adjacent motorized conveyor.

5. A process as claimed in claim 2, wherein the processing of the last bundle of the stack also includes operations involving the automatic separation and elimination of the last sheet of this bundle.

6. A process as claimed in claim 5, which involves delaying the last sheet of the said last bundle during the said operation of dropping the latter downwardly, retaining this sheet during the said operation of discharging this last bundle, then discharging this sheet along a different path.

7. A process as claimed in claim 6, wherein the last operations in the processing of the said last bundle are carried out in the following way:

this bundle is dropped downwardly, and the last sheet of this bundle is grasped during the drop of the said bundle
the operations of squaring the said bundle and raising it to a horizontal position are carried out,
the operation of discharging this bundle is carried out, but with the said last sheet being retained,
this last sheet is eliminated by discharging it along a different path.

8. A process as claimed in claim 7, wherein the operation of raising the said bundle to a horizontal position is carried out without continuing to grasp the said last sheet.

9. A process as claimed in claim 2 wherein the bundle, after being stopped upright on its edge, it also turned over by tilting it before bringing it into a virtually horizontal position.

10. An apparatus for the automatic supply of a machine for processing products in the form of sheets, comprising:

a device (3, 10, 4) intended for separating a bundle (80) from the top of a stack of blanks (14) by placing the said bundle upright on its edge,
a device (4) intended for causing the virtually vertical drop of the said bundle, said device incorporating a retractable support (19), and a guide and receiving device (5, 7) making it possible to stop the said bundle, after its drop, still standing on its edge,
a device (6) for squaring the said bundle laterally after its drop,
a device (7, 8) for raising the bundle to a horizontal position, and
a device (9) for receiving and discharging the bundles.

11. An automatic supply apparatus as claimed in claim 10, wherein the device for guiding and receiving the bundle during its drop incorporates a device (25) accompanying the edge of the bundle in the drop of the said bundle.

12. An automatic supply apparatus as claimed in claim 11, wherein the, accompanying device consists of a support (25) driven in a downward movement.

13. An automatic supply apparatus as claimed in claim 12, wherein the said support consists of a conveyor motorized at least in its upper position.

14. An automatic supply apparatus as claimed in claim 10, wherein the said device for raising the bundle to a horizontal position comprises a table (7), which can be inclined as a result of rotation about an upper axis (29), and a curved surface (8) opposite the latter.

15. An automatic supply apparatus as claimed in claim 14, wherein the inclinable table (7) is located upstream of the curved surface (8), and wherein the said curved surface has the form of an arc of a circle widened ($\alpha$) in a spiral downstream (FIG. 9).

16. An apparatus as claimed in claim 10, which also incorporates:

means for detecting the presence of the last bundle (95 in FIG. 16) of the stack, means (96) for grasping the last sheet (97) of this bundle in its travel during its virtually vertical drop, means (98) for retaining this last sheet during the discharge (FIG. 20) of this bundle after the latter has been raised to a horizontal position, means (102, 99) for discharging this last sheet along a different path (101).

17. An apparatus as claimed in claim 16, wherein the means (96) for grasping the said last sheet and the means (98) for retaining the latter are retractable and coupled (FIG. 26).

18. An automatic supply apparatus as claimed in claim 14, wherein the inclinable table (7) is located downstream of the curved surface (8), and which also incorporates a device (90, 92) making it possible to tip the bundle (93) onto the said inclinable table after the virtually vertical drop of the said bundle (FIGS. 16, 19 and 20).

19. A device as claimed in claim 10, including retractable means (137) for pushing the rear of the bundle comprising upstream and downstream carriages (138, 139) which move in a longitudinal direction on adjacent tracks (140, 141), the downstream carriage (139) moving on its track with a friction greater than that of the upstream carriage (138) on its track, the two carriages being connected by two elements (143, 144) articulated to one another and to each carriage.

* * * * *